US005743777A

United States Patent [19]

Demeuter

[11] Patent Number: 5,743,777

[45] Date of Patent: Apr. 28, 1998

[54] METHOD OF MANUFACTURING NICKEL CORE COPPER CENTER ELECTRODES

[75] Inventor: Andre Demeuter, West Kirby, England

[73] Assignee: Cooper Industries, Inc., Houston, Tex.

[21] Appl. No.: 851,492

[22] Filed: May 5, 1997

Related U.S. Application Data

[63] Continuation of Ser. No. 654,008, May 29, 1996, abandoned, which is a continuation of Ser. No. 283,872, Aug. 1, 1994, abandoned.

[30] Foreign Application Priority Data

Aug. 2, 1993 [EP] European Pat. Off. ..... 93306092

[51] Int. Cl.[6] ..... H01T 21/02; H01T 13/39

[52] U.S. Cl. ..... 445/7; 313/11.5; 313/141

[58] Field of Search ..... 313/138, 141, 313/142, 144, 148, 11.5; 445/7

[56] References Cited

U.S. PATENT DOCUMENTS

| | | | |
|---|---|---|---|
| 2,783,409 | 2/1957 | McDougal | 313/141 |
| 3,407,326 | 10/1968 | Romine | 313/141 |
| 4,585,421 | 4/1986 | Payne | 445/7 |
| 4,826,462 | 5/1989 | Lenk | 445/7 |
| 4,904,216 | 2/1990 | Kagawa et al. | 445/7 |
| 5,210,457 | 5/1993 | Oshima et al. | 313/11.5 |

FOREIGN PATENT DOCUMENTS

| | | | |
|---|---|---|---|
| 0164613 | 12/1985 | European Pat. Off. | H01T 13/20 |
| 0355052 | 2/1990 | European Pat. Off. | H01T 21/02 |
| 2451648 | 10/1980 | France | H01T 13/20 |
| 2024929 | 1/1980 | United Kingdom | H01T 13/20 |
| WO 91/15887 | 10/1991 | WIPO | H01T 13/20 |

*Primary Examiner*—Brian Zimmerman
*Assistant Examiner*—Michael Day
*Attorney, Agent, or Firm*—Fish & Richardson P.C.

[57] ABSTRACT

The present invention relates to a spark plug electrode (14) of a first material having good thermal conductivity having a core (24) of a second material having good corrosion resistance. The first material may be copper, or a copper alloy, and the second material may be nickel, a nickel alloy, silver, or a silver alloy. The electrode (14) may be produced by a method comprising the steps of: providing a tubular cup (28) formed of the first material; positioning a billet (34) of the second material within the cup (28); and extruding the assembled cup and billet.

13 Claims, 3 Drawing Sheets

METHOD OF MANUFACTURING NICKEL CORE COPPER CENTER ELECTRODES

This application is a continuation of U.S. application Ser. No. 08/654,008, filed May 29, 1996, now abandoned, which is a continuation of U.S. application Ser. No. 08/283,872, filed Aug. 1, 1994, now abandoned.

BACKGROUND OF THE INVENTION

1. Field of the Invention

The present invention relates to electrodes for use in spark plugs for internal combustion engines. The invention also relates to a method of producing such electrodes.

2. Related Art

A spark plug typically comprises an outer shell, a central electrode, an insulator surrounding the central electrode, and a ground electrode connected to the outer shell and forming a spark gap with the bottom end portion of the central electrode.

Spark plugs may be provided with electrodes formed of a single material, or may be made of two different materials, examples of such composite electrodes being described in our European Patent Publication No. 0537156. This document discloses centre and ground electrodes provided with an outer layer formed of a corrosion resistant material, such as nickel or a nickel alloy, and an inner core formed of a material having good thermal conductivity characteristics and good corrosion/erosion resistance, such as silver or a silver alloy. Also disclosed is an electrode inner core formed of two materials, the first material nearest to the spark gap having good thermal conductivity characteristics and good corrosion/erosion resistance such as silver or a silver alloy, and a second material away from the spark gap having good thermal conductivity characteristics, such as copper or a copper alloy. Such electrodes are produced by a first forming a tubular cup from nickel, positioning a cylindrical billet of silver or copper in the cup, and then extruding the assembled part to form the elongate electrode.

The core of copper or silver provides for better spark plug performance due to the relatively high thermal conductivity characteristics of the materials; the inner core conducts more rapidly the heat produced by the combustion or the air/fuel mixture in the combustion chamber of the engine, so that the electrodes of the spark plug will remain cooler when the engine is running. This cooling action has a positive effect on the performance and on the useful life of the spark plug because it reduces the corrosion and the erosion of the electrode. The corrosion resistant nickel which forms the bulk of the electrode has good corrosion resistant properties and thus prolongs the life of the spark plug.

One disadvantage of such electrodes is the relatively high cost of nickel, which forms the bulk of the electrode. Also, nickel has a relatively high hardness and is therefore more difficult to form and extrude during the manufacturing process.

SUMMARY AND OBJECTS

According to one aspect of the present invention there is provided a spark plug electrode of a first material having good thermal conductivity, the electrode having a core tip of a second material having good corrosion resistance.

The electrode is preferably a centre electrode.

The first material may be copper or a copper alloy, and the second material may be nickel, a nickel alloy, silver, or a silver alloy.

Such an electrode is of relatively low cost, due to the smaller proportion of the generally more expensive second material that must be provided. Further, the electrode has better thermal conductivity characteristics due to the larger proportion of the first material present. It has also been found that spark plugs provided with such electrodes have an unexpectedly high heat range rating for given core nose lengths.

The spark surface of the electrode is preferably formed only of said second material. Alternatively, the electrode may be provided with a precious metal pad of, for example, platinum alloy or gold palladium alloy. The pad may be resistance welded to the electrode. Such a pad will tend to increase the life of the electrode.

The electrode is preferably produced by a method comprising the steps of: providing a tubular cup formed of one of said first material or said second material; positioning a billet of the other of said first material or said second material within the cup; and extruding the cup and billet.

The use of a relatively soft first material facilitates the process, reducing production costs, for example by requiring less expensive tooling and fewer extrusion steps. Further, the relatively low level of deformation of the second material allows the use of harder materials to form the core tip. The extrusion process also permits an increase in the core nose length, which assists in cold fouling reduction.

The invention also relates to a spark plug provided with such an electrode.

BRIEF DESCRIPTION OF THE DRAWINGS

These and other aspects of the present invention will now be described, by way of example, with reference to the accompanying drawings, in which.

DETAILED DESCRIPTION OF THE PREFERRED EMBODIMENTS

Figure 1:
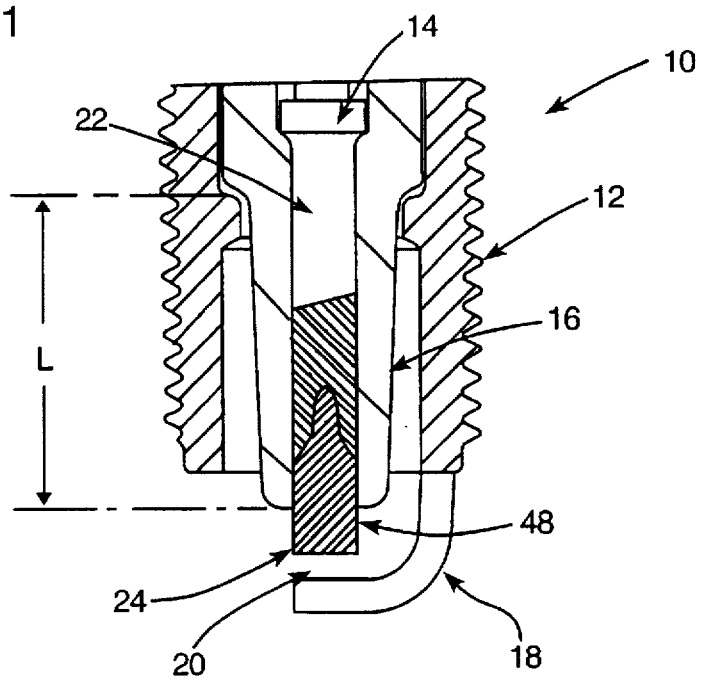
FIG. 1 is a sectional view of part of a spark plug in accordance with a preferred embodiment of the present invention.

Reference is first made to FIG. 1 of the drawings which illustrates the lower part of a spark plug 10 comprising an outer shell 12, a central electrode 14, an insulator 16 and a ground electrode 18. Between the central electrode 14 and the ground electrode 18 there is a spark gap 20.

The invention relates in particular to the structure of the central electrode 14 which in the illustrated embodiment comprises a body 22 of copper, providing good thermal conductivity, and a core tip 24 of nickel, providing good corrosion resistance in a region of the electrode opposing the ground electrode. This is in contrast to the prior art in which the body would typically be formed of nickel and the core tip formed of copper.

Figure 2:
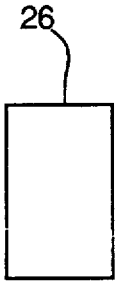
FIGS. 2 through 11 illustrate various stages in the production of the electrode of FIG. 1.
Figure 3:
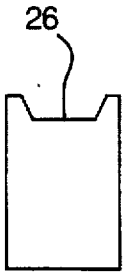
Figure 4:
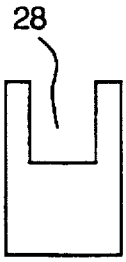

Reference is now also made to FIGS. 2 to 11 which illustrate, in sequence, the various steps involved in the production of the electrode 14. FIG. 2 illustrates a copper billet 26 which is deformed in two stages, as illustrated in FIGS. 3 and 4, to produce a copper cup 28 having closed and open ends 30, 32.

Figure 5:
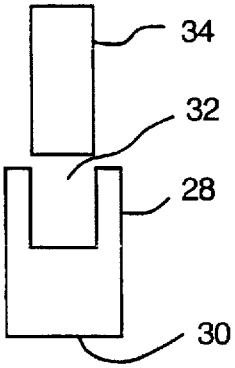
Figure 6:
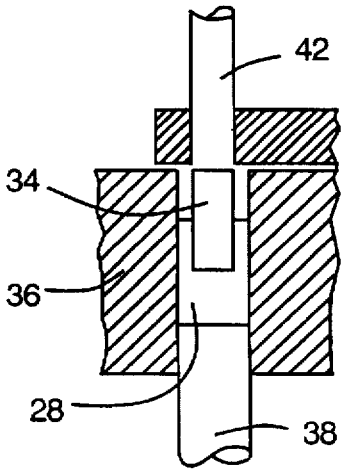
Figure 7:
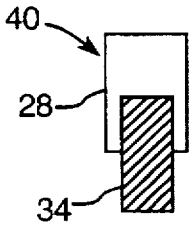

A slug or billet 34 of nickel, dimensioned to be received within the cup 28, is then provided, as illustrated in FIG. 5. As shown in FIG. 6, the billet 34 is located in the cup 28 by placing the cup in a holder 36 supported by a knock-out pin 38 and pushing the billet 34 into the cup by means of a sinking punch 42. The knock-out pin 38 then pushes the assembled parts from the holder 36. The resulting assembly 40 is illustrated in FIG. 7. It will be noted that although both the cup and the billet 28, 34 are shown in section, for clarity only the billet 34 is cross-hatched.

Figure 8:
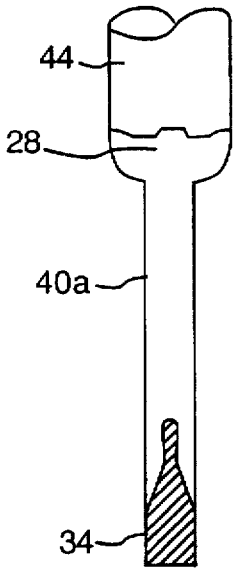
Figure 9:
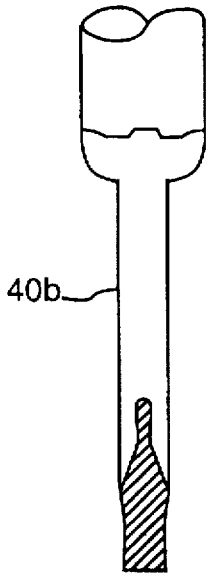
Figure 10:
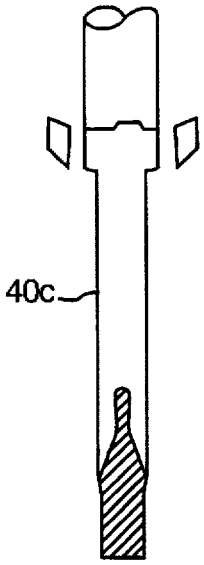
Figure 11:
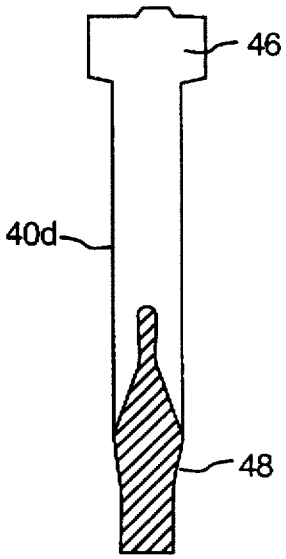

Reference is now made to FIGS. 8, 9 and 10 which illustrate the form of the assembly 40*a*, 40*b*, 40*c* after extrusion through first, second and third dies, respectively. Although not illustrated, it will be clear to those of skill in the art that such an extrusion process may be carried out by locating the assembly 40 into a close fitting bore of an extrusion die having a reduced diameter extrusion orifice and advancing a punch 44 into the bore to force most of the composite assembly 40 through the extrusion orifice, leaving an extrusion butt 46 above the extrusion orifice. The fully extruded assembly 40*b* is illustrated in FIG. 11, ready for finishing to an appropriate form, such as illustrated in FIG. 1. It will be noted from FIGS. 8 to 11, and also FIG. 1, that this process produces a relatively long core nose 48, which reduces cold fouling, as described more fully below.

An increase in core nose length increases the path over which the spark would shunt to the spark plug shell if the insulator was covered with carbon deposit, i.e. during cold start operation. On the other hand, if the tip of the electrode is too long it becomes too hot, causing pre-ignition which can result in severe engine damage. Accordingly, a better quality spark plug will provide the advantages associated with a longer core nose length, while being capable of operating over a range of temperatures without the danger of pre-ignition at higher operating temperatures, that is the insulator core length should be maximized for a given heat range. The qualities are currently measured by determining the relationship between the insulator core nose length (L: see FIG. 1) and the SAE standard Labero engine IMEP rating method, or the pre-ignition safety margins. The spark plug heat ranges are typically defined by a number between "6" and "12", a lower number indicating a colder heat range with a shorter core nose length.

To demonstrate the performance of a spark plug made in accordance with the above described embodiment, a prototype plug C was compared with two conventional production spark plugs A, B. The plugs were tested according to the SAE standard Labero engine IMEP rating method and also the multicylinder spark advance pre-ignition safety margin method, to determine the heat range ratings.

Results of the heat range tests are shown below, along with the insulator core nose lengths of the test samples.

| SPARK PLUG | INSULATOR CORE NOSE LENGTH | IMEP RATING | PRE-IGNITION SAFETY MARGIN (°SA) |
|---|---|---|---|
| A. RC12YCC | .700" | 245 | 4° |
| B. RC9YCC | .560" | 300 | 13° |
| C. C102YCC | .700" | 297 | 12° |

The test results show that the electrode utilized in the C102YCC plug results in a plug with a heat range comparable with a conventional "9"—rated plug, but with the insulator core nose length typically found in a "12"—rated plug. This represents a major improvement in performance, compared to conventional spark plug designs.

The electrode 14 described above will also tend to have a lower materials cost than a conventional composite electrode, as the bulk of, i.e., major portion, of the electrode is formed of relatively inexpensive copper. It is estimated that around 50% less nickel is required to produce an electrode as described above, as compared to a conventional composite electrode. Further, the increase in the proportion of copper present in the electrode produces an electrode with better thermal conductivity characteristics which, in addition to the improved heat rating, reduces wear of the electrode tip. It will also be noted that it is the copper portion of the assembly which is subject to greatest deformation and, as the copper is relatively soft, tooling costs will tend to be lower. Also, as the core tip is subject to relatively little deformation, harder alloys may be utilised to form the electrode core.

Figure 12:
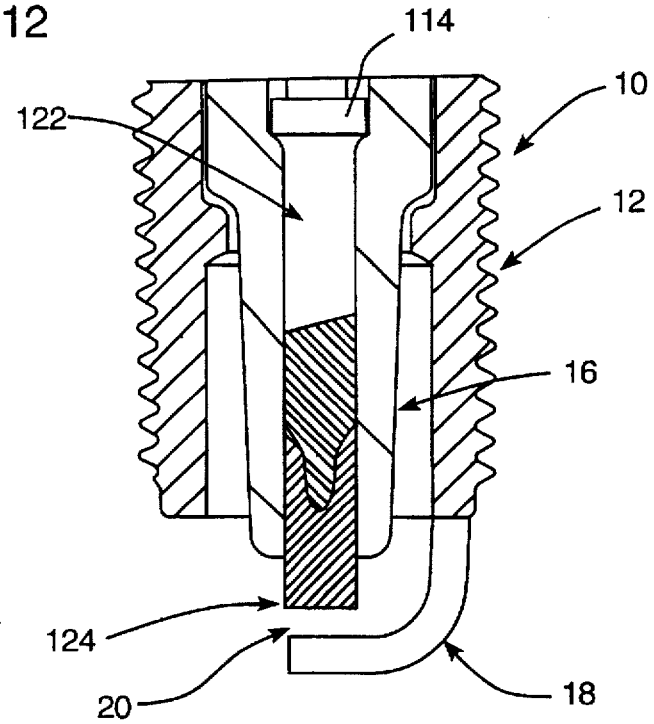
FIG. 12 is a sectional view of part of a spark plug in accordance with a further embodiment of the present invention.

It will be clear to those of skill in the art that the abovedescribed embodiment is merely exemplary of the present invention and that various modifications and improvements may be made to this embodiment without departing from the scope of the invention. Such a modification is illustrated in FIG. 12 of the drawings, in which the central electrode 114 has been formed by extruding a copper billet and a nickel cup to form an electrode 114 having, as with the first described embodiment, a copper body 122 and a nickel core 124. As in the first described embodiment, the extrusion process is such that the softer copper is subject to a greater degree of extrusion.

Figure 13:
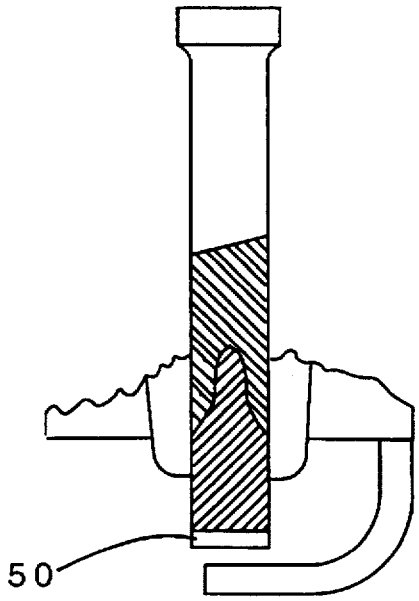
FIG. 13 is a view of an alternative embodiment of the present invention.

In a further modification the electrode tip may be provided with a resistance welded precious metal tip 50, to extend the life of the electrode. See FIG. 13. Also, the electrode tip may be tapered or shaped to increase ignitability.

I claim:

1. A method of producing an electrode for a spark plug, the method comprising the steps of:

providing a tubular cup having an opening and being formed of a first material having high thermal conductivity;

positioning a billet of a second material having higher corrosion resistance than the first material in the opening of the tubular cup, with the billet being positioned so that an end of the billet extends beyond all portions of the tubular cup; and extruding the cup and billet to form an electrode.

2. The method of claim 1, wherein the first material is copper or a copper alloy.

3. The method of claim 2, wherein the second material is nickel.

4. The method of claim 2, wherein the second material is a nickel alloy.

5. The method of claim 2, wherein the second material is silver or a silver alloy.

6. The method of claim 1, wherein the second material is nickel.

7. The method of claim 1, wherein the second material is a nickel alloy.

8. The method of claim 1, wherein the second material is silver or a silver alloy.

9. The method of claim 1, further comprising attaching a metal pad to an end of the electrode to form a spark surface.

10. The method of claim 9, wherein the metal pad is formed from a precious metal.

11. The method of claim 1, wherein the billet forms a core tip of the electrode and wherein said step of extruding comprises extruding the cup and billet so that a portion of the second material extends into the first material.

12. The method of claim 1, wherein the tubular cup is formed from the first material and is larger than the billet so that a major portion of the electrode is formed from the first material.

13. The method of claim 1, wherein said step of extruding comprises extruding the cup and billet so that the electrode has a sparking surface tip made from the second material and not from the first material, with the sparking surface tip having a length that allows a relatively long core nose length to reduce cold fouling.

* * * * *